US005488268A

United States Patent [19]

Bauer et al.

[11] Patent Number: 5,488,268

[45] Date of Patent: Jan. 30, 1996

[54] ELECTRICAL CONNECTOR WITH IMPROVED CENTERING OF MATING TERMINAL PINS, FOR A FLUORESCENT-LIGHTING BALLAST

[75] Inventors: Fred P. Bauer, Mendenhall; Stuart E. Sanders, Brandon, both of Miss.; Raymond H. Van Wagener, Darien, Conn.; Mark R. Opperthauser, Jackson, Miss.

[73] Assignee: Magnetek, Inc., Los Angeles, Calif.

[21] Appl. No.: 224,811

[22] Filed: Apr. 8, 1994

Related U.S. Application Data

[63] Continuation-in-part of Ser. No. 9,645, May 14, 1993, Pat. No. 5,350,316, and a continuation-in-part of Ser. No. 680, 699, Apr. 4, 1991, Pat. No. 5,260,678.

[51] Int. Cl.[6] ..... H01J 7/44

[52] U.S. Cl. ..... 315/70; 315/57; 439/460; 336/107

[58] Field of Search ..... 315/70, 57; 439/460, 439/562; 361/377; 336/107

[56] References Cited

U.S. PATENT DOCUMENTS

| | | | |
|---|---|---|---|
| 2,487,468 | 11/1949 | Naysmith | 240/51.11 |
| 3,514,590 | 5/1970 | Shaeffer | 240/51.1 |
| 4,410,230 | 10/1983 | Sun Miguel | 339/176 |
| 4,414,489 | 11/1983 | Young | 315/57 |
| 5,345,143 | 9/1994 | Little | 315/70 |

*Primary Examiner*—Robert J. Pascal
*Assistant Examiner*—Reginald A. Ratliff
*Attorney, Agent, or Firm*—Seldon & Scillieri

[57] ABSTRACT

One half-connector terminates a set of leads in the ballast, for carrying electrical power to and from the ballast coils. Another half-connector terminates another set of leads outside the ballast, connected e.g. to carry power to lamp sockets. Male contacts, preferably formed very inexpensively as bared ends of one set of leads, are held in a first of the half-connectors; female contacts, connected to the other set of leads, are held in a second of the two half-connectors. Through-holes in the second half-connector each hold one female contact; each hole has a necked-down section, forward from the contact, and some device (preferably an ultrasonically displaced slug) to retain the contact. In one aspect of the invention, each hole also has a bore whose transverse preformed dimension is biggest immediately rearward from the necked-down forward section. In a second aspect of the invention, each necked-down section has a large-mouthed funnel to guide even a badly bent male contact into the female contact, accommodating weak tips of the bared wire ends. The first aspect of the invention enables low-cost use of the second.

29 Claims, 3 Drawing Sheets

ELECTRICAL CONNECTOR WITH IMPROVED CENTERING OF MATING TERMINAL PINS, FOR A FLUORESCENT-LIGHTING BALLAST

RELATED APPLICATIONS

This is a continuation-in-part of coowned U.S. utility-patent application Ser. No. 08/009,645, filed on May 14, 1993, and issued Sep. 27, 1994 as U.S. Pat. No. 5,350,316; and thereby of its parent application, U.S. utility-patent application Ser. No. 07/680,699, filed Apr. 4, 1991, and issued Nov. 9, 1993, as U.S. Pat. No. 5,260,678.

BACKGROUND

1. Field of the Invention

This invention relates generally to fluorescent-lighting fixtures; and more particularly to novel electrical connecting systems for such fixtures.

2. Prior Art

The working parts of fluorescent fixtures, sometimes called "luminaires", constitute a difficult field characterized by extremely high sales volumes, low unit prices and extremely competitive pricing. These factors magnify differences of a fraction of a cent in component cost, assembly time, and inventorying or shipping efforts—and relatively small differences in installation convenience—into major concerns.

Traditionally transformers or "ballasts" for fluorescent fixtures were made with protruding electrical leads for individual connection to the fixture wiring by installation personnel. That work was done, either in the fixture factory or (especially for replacement ballasts) in the field, using individual, manual splicing techniques such as wire nuts.

The evident labor-intensiveness of such procedures, as well as inventory ramifications, have led the industry in recent years to introduce the so-called "leadless" ballast. Such a ballast has an associated electrical half-connector, which is sometimes (but not necessarily) mounted to or in the wall of the ballast housing.

The ballast-associated half-connector terminates all or nearly all the leads from the electrical windings which are within that housing. A mating half-connector terminates the leads from lamp sockets that form part of the luminaire, so that the electrical-connection part of the installation process may be reduced to simply plugging one half-connector into the other.

In most leadless-ballast configurations the two incoming power leads are also wired through this same connector. In some configurations those two leads, or for instance special sensing or control-signal leads, may be handled separately.

It is important to note—as will be more fully appreciated later—that strain-relief provisions for each lead, at both sides of the connector, are essentially a requirement in the fluorescent-lighting industry as they are required for approval by safety-certifying organizations such as the Underwriters Laboratories®. Strain relief is more important in this field than in most consumer-product industries because ballasts are very heavy and luminaires are typically mounted overhead; if the mechanical connections of a ballast are not completed properly, the wiring provides a last-ditch backup against potentially severe injury or property damage below.

Most typically all the male terminals or contacts are held in one of the two half-connectors—usually and preferably the ballast-associated half, but sometimes the fixture-associated half. Correspondingly the female contacts are held in the other half-connector (i.e., usually but not necessarily the fixture-associated half).

In principle male contacts can be used for some leads and female contacts for other leads within each half-connector, but this is not popular in the industry. At any rate each contact typically is held within its own respective through-hole, formed fore-to-aft through the half-connector.

A favored type of contact, particularly for the female contacts, in leadless-ballast connectors is the well-known rolled sheet-metal variety that has outward-biased retaining tangs. During contact installation (forward insertion from the rear of the half-connector) the tangs are compressed radially inward—generally into line with the cylindrical rolled body of the contact—allowing the contact to pass forward through a cylindrical inner surface of an inner flange or ledge, molded as part of the interior surface of the through-hole.

After passing through the flange, the tangs spring outward radially so that their tips can bear longitudinally against the annular surface of the flange or ledge: the annular ledge thus serves as a tang stop. In this way the tangs and ledge cooperate to prevent the contact from escaping rearward from its through-hole.

Contacts of this configuration can be used for the male pins as well. In the interest of economy, however, some commercial configurations instead simply use the bared ends of the electrical leads—i.e., bared wire ends—as the male contacts.

A male contact of this type is extremely attractive because it is essentially free of material cost. The very slight additional length of wire substitutes entirely for a rolled or other formed male pin, thus eliminating entirely the cost of a formed pin; and the bared-wire-ends technique adds at most a minor smoothing of the cut tips.

The wires whose ends are bared may be held in the half-connector through-holes using adhesive, or slug locks as described in the parent patent documents identified earlier, or by sideways-driven wedging devices, or by ultrasonically fusing material of the half-connector with insulation adjacent to the bare wire ends, or through other fastening techniques.

Unfortunately, the economic appeal of such bared-wire-end contacts is not fully met in practice, for they do not engage the female contacts as reliably. The reason is that the bare-end contacts are typically less rigid than, and lack the bullet nose or profile of, the rolled sheet-metal contacts.

During contact installation or handling, before mating of the two half-connectors to install the ballast, the tips of the bared wire ends are somewhat more susceptible to bending away from a nominal straight-in-line position relative to the through-hole. Such bent, untapered ends fail to pass smoothly into the female contacts. A solution would be particularly useful in this case, though even formed pins can misalign.

The tantalizing economies of the bare-wire-end contact place a premium on effective but inexpensive provisions for reinforcing or recentering the male-contact tip or otherwise guiding it into its respective female contact. Heretofore no such effective but inexpensive provision has appeared.

Standard female contacts do have a forward-facing bell intended to help capture male-contact tips that are only slightly off-center. The bell diameter, however, is severely limited—by the requirement that the bell, as well as the rest of the female contact, must pass through the small-diameter internal flange or tang stop.

Because the diameter of the bell must be so small, while it may be adequate for the small amount of out-of-line deformation likely to occur in a relatively strong rolled-metal metal pin it is inadequate for the greater deformation that often occurs in a relatively weaker bared-wire-end male contact. The overall result is that the standard-size bell is ineffective: the contacts fail to engage.

In theory a larger-diameter centering bell can be provided if the female contact is inserted rearward into its through-hole from the front of the half-connector, rather than forward from the back. This technique, however, requires threading each wire, too, rearward through the hole, in advance of the contact—and only after that making the connection of the opposite end of that wire with its socket, winding, etc.

This threading operation is very time consuming, and the associated sequence of operations (socket or winding connection after threading) is relatively awkward. Thus use of a large-bell female contact would generate added costs—possibly even high enough to negate the savings of the bared-wire-end contacts—and is unacceptable.

Therefore full enjoyment of the potential economy of bared-wire male pins has not been possible heretofore. As can now be seen, important aspects of the technology used in the field of the invention are amenable to useful refinement.

SUMMARY OF THE DISCLOSURE

The present invention introduces such refinement, and enables full realization of the great economies associated with using bared wire ends as male contacts. The invention has at least two independently usable facets or aspects, which will now be introduced.

These aspects or facets, however, do have several elements in common. The common parts will be described first.

In its preferred embodiments, the present invention is, in combination, a ballast and connecting apparatus for use in a fluorescent-lamp fixture having lamp sockets. (The fixture itself, i.e. the luminaire, is not part of the combination as defined in most of the appended claims—except for certain elements that are specifically recited below.)

The combination includes at least one electrical winding mounted within the ballast. The combination also includes two pluralities of electrical leads within such a fluorescent-lamp fixture:

one plurality of electrical leads within the ballast and operatively connected to the winding, for carrying electrical power to and from the winding, and another plurality of electrical leads extending through the fixture substantially outside the ballast, at least some of these leads being operatively connected with lamp sockets of the fixture for carrying electrical power to the sockets.

In addition the combination includes two mutually matable electrical half-connectors: one for terminating the above-mentioned "one plurality" of leads and another for terminating the other plurality of leads.

Also included is a plurality of individual electrical male contacts, formed from or operatively connected to one (either one) of the two pluralities of electrical leads respectively, and fixed within a first of the two half-connectors. (This is in effect a definition of what we mean by the "first" half-connector.)

The combination further includes a plurality of individual electrical female contacts, operatively connected to the other of the two pluralities of electrical leads respectively, and fixed within a second of the two half-connectors. (This defines which half-connector we will call the "second".)

The combination also includes a plurality of through-holes defined within the second half-connector, each through-hole holding a respective one of the female contacts, and each through-hole having:

a rearward end for receiving insertion of one female contact, a forward end for receiving insertion of a part of one male contact, extending from the first half-connector, into the female contact to complete connections from the ballast winding to the lamp sockets, a necked-down section, forward from a forward tip of the female contact in that hole, and means for retaining each female contact in its respective hole.

Now in preferred embodiments of a first of the independent aspects or facets of the invention, each through-hole also has a preformed bore whose transverse preformed dimensions along the entire length of the bore rearward from the necked-down forward section are at least as great as its transverse dimensions immediately rearward from the necked-down forward section. In other words, a rear chamber is formed behind the necked-down section, the female contact is disposed entirely within (or protruding rearward from) this rear chamber, and the smallest preformed transverse dimension of this chamber is at its forwardmost end.

In purest principle it is possible to make the entire rear chamber of uniform transverse dimension; in this case the preformed transverse dimension at the forwardmost end would be not only the smallest but also the largest preformed transverse dimension along the length of the rear chamber. This point is academic, however, since as a practical matter some draft is required in molding the half-connector, to facilitate removal of the half-connector from its mold; this draft ensures that the preformed transverse dimension at all points rearward from the front end of the chamber will actually be larger than that at the front end.

In this aspect of the invention, the female-contact retaining means mentioned above retain each contact in its respective bore. The word "preformed" in the above description is important because the retaining means, when they are in effect, typically do reduce the net transverse dimension of the chamber at some point rearward from the front end of the chamber. The retaining means, however, typically must be put into effect after each respective female contact is already installed in the half-connector; thus the retaining means are not "preformed".

The foregoing may be a description or definition of the first facet or aspect of the present invention in its broadest or most general terms. Even in such general or broad form, however, as can now be seen the first aspect of the invention resolves the previously outlined problems of the prior art.

In particular use of such a bore frees the mold designer to configure the forward part of each through-hole—i.e., the necked-down portion—in virtually any geometry desired. In particular the designer can use this new freedom to contour the forward part of the hole to capture its corresponding male contact tip, even if that tip is bent badly away from a nominal centered shape, and guide the tip accurately into the female contact.

In this way the invention accommodates the relatively weaker tips of the bared-wire-end male contacts discussed in the preceding section of this document. As will be shown in later passages of this document, the invention accommodates such male contacts with no associated additional cost, and so enables the desired full realization of economies associated with such contacts.

Now turning to a second of the independent facets or aspects of the invention: in preferred embodiments of this second facet, each through-hole has a funnel-shaped forward opening, defined in a forward face of the necked-down section. This funnel-shaped forward opening is for guiding the above-mentioned inserted part of the corresponding male contact into the female contact.

The foregoing may constitute a definition or description of the second facet or aspect of the present invention in its broadest or most general terms. Even in such general or broad form, however, as can now be seen the second aspect of the invention resolves the previously outlined problems of the prior art.

In particular such a funnel-shaped opening can have a much wider mouth than the bell of the female contact—but a narrowed throat equal to or even smaller than than the female-contact bell—and so can capture the corresponding male contact tip even if that tip is bent very severely away from a nominal centered shape, and can guide the tip accurately into the female contact.

In this way this second facet of the invention too accommodates the relatively weaker tips of the bared-wire-end male contacts, and again (as will be seen) with no associated additional cost. Hence this facet of the invention promotes and enables the desired economy that accompanies use of bared wire ends as male contacts.

Although preferred embodiments of the invention in either of its two major facets thus provide very significant advances relative to the prior art, nevertheless for greatest enjoyment of the benefits of the invention it is preferably practiced in conjunction with certain other features or characteristics which enhance its benefits. For example, although the two aspects of the invention may in principle be practiced separately, it is preferred that both be used in mutual conjunction together.

Further it is preferred that the combination further include a plurality of protruding generally conical guards, defined in the material of the first half-connector, encircling each of the male contacts respectively. These conical guards are to protect the associated male contacts and help guide the to-be-inserted part of each male contact into the funnel-shaped opening in the second half-connector.

It is also preferable that the female-contact retaining means include one or more wall portions of the second half connector, displaced into or around the leads or the female contacts in the second half connector to hold those leads or the female contacts in place within the second half connector. These wall portions are displaced in this way only after each female contact is installed in its respective through-hole, and so are not part of the "preformed" bore mentioned earlier in relation to the first aspect of the invention.

In this way each female contact is held in place without need for the internal flange or ledge employed for this purpose in the prior art—and at the same time strain relief is provided for each lead or contact in the second half connector. In the prior art, as mentioned previously, very effective strain relief must be provided anyway even though the internal flanges hold the contacts in place.

Here both these functions are performed by the same retaining means, without using any additional component. Thus as mentioned above the bared-wire-end male contacts are accommodated without any additional cost, thus making available the full savings associated with elimination of separate, formed male contacts.

Certain forms of the displaced wall portions that serve as retaining means include preformed pieces driven inward to engage the leads or the female contacts. More preferably the displaced wall portions are driven inward and disposed behind the female contacts to engage the leads, and preferably are fused—most preferably by ultrasonic or other vibratory welding—with insulation material of the leads.

Alternative female-contact retaining means, however, are within the scope of our invention. The retaining means may include adhesive for securing the contacts or the leads to the second connector body; or may include at least one retainer held at the rear of the second half-connector by snap-together construction.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
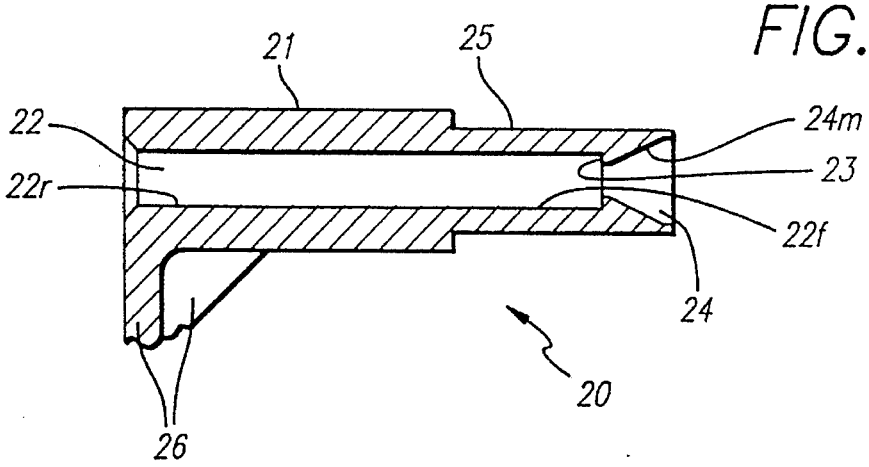
FIG. 1 is a longitudinal vertical section of a preferred embodiment of the "second" half-connector of our invention, before insertion of a lead or contact and before the contact-retaining means are put into effect.

Each female pin 30 in the second half-connector body 20 occupies (but may protrude rearward from) a rearward chamber 22 of a preformed bore 22–24; the bore also has a necked-down forward section 23. This section 23 provides a positive stop for the forward bell and tip 31 of the female contact 30, and provides a capturing-and-guiding funnel 24 whose mouth 24*m* is much wider than the bell 31 of the female contact 30.

Figure 2:
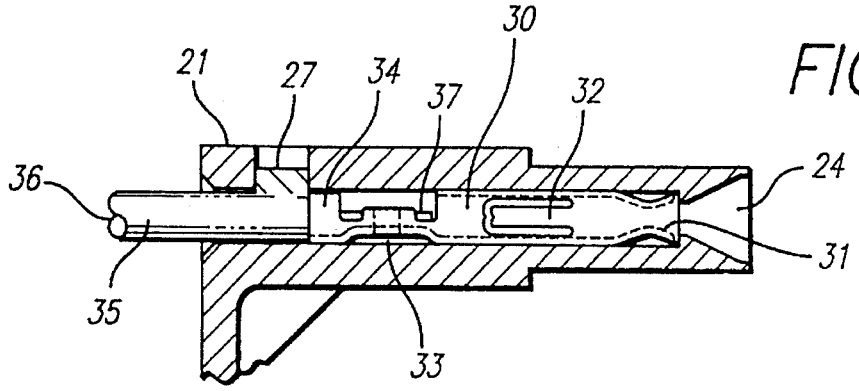
FIG. 2 is a like section of the same half-connector, but now with a representative associated lead and female contact installed (internal surfaces of the contact being shown in dashed lines in this view), and after a preferred form of the contact-retaining means has been put into effect.

In the drawings of the preferred form of the invention (FIGS. 1 through 3) each preformed rear chamber 22 (i.e., the part of the preformed bore that is rearward from the necked-down forward portion 23) appears to be of uniform transverse dimension. Actually it is preferably formed with a very slight draft or taper, opening outward slightly from the front end 22*f* toward the rear end 22*r*, to facilitate extraction of the part 20 from its mold.

Figure 4:
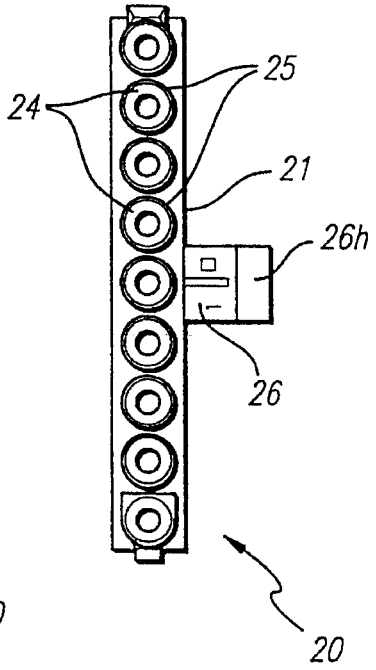
FIG. 4 is a front elevation of the same half-connector, but shown rotated for ready association with FIG. 3.

We prefer that all the through-holes 22–24 be formed with circular-cylindrical symmetry, as suggested in FIG. 4, so that no rotational alignment of the contacts 30 in their respective bores 22 is needed. In this preferred geometry the "transverse dimensions" mentioned earlier are diameters or radii.

Figure 3:
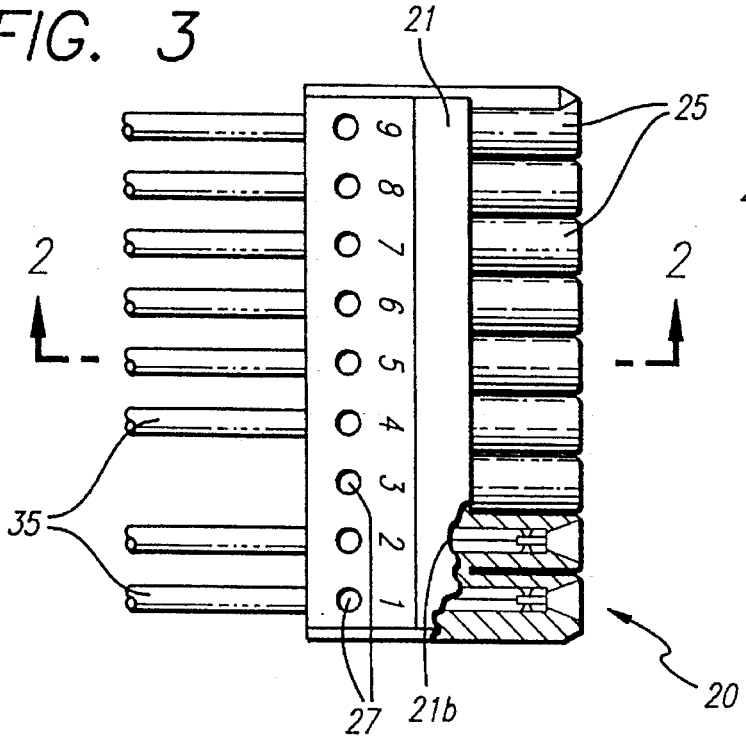
FIG. 3 is a plan view, partly in longitudinal horizontal section, of the same half-connector with its associated leads —FIG. 2 being a section taken along the line 2—2 in FIG. 3.
Figure 5:
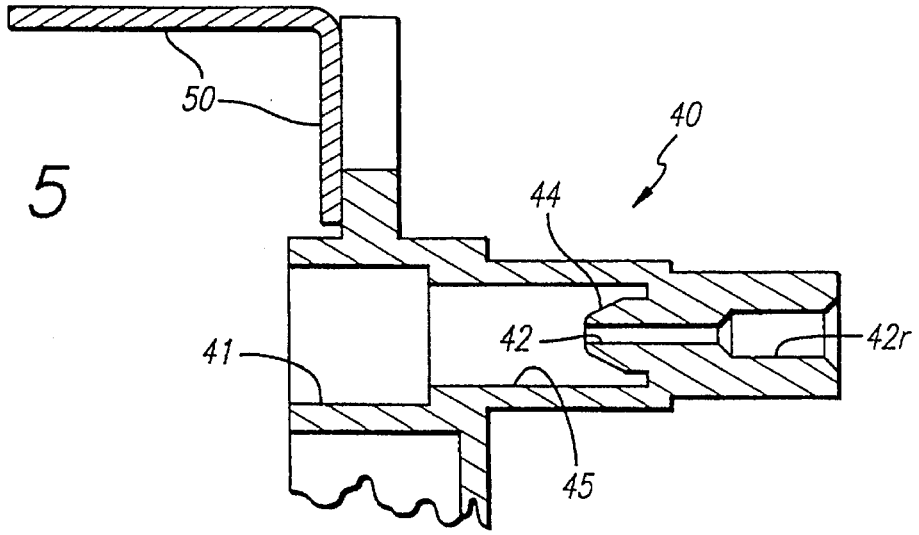
FIG. 5 is a section, like FIG. 1, of a preferred embodiment of the "first" half-connector, shown installed in a ballast end-wall but before a lead or contact has been installed and before any lead-retaining means are put into effect (as will be understood, actual assembly does not necessarily proceed in this sequence)
Figure 6:
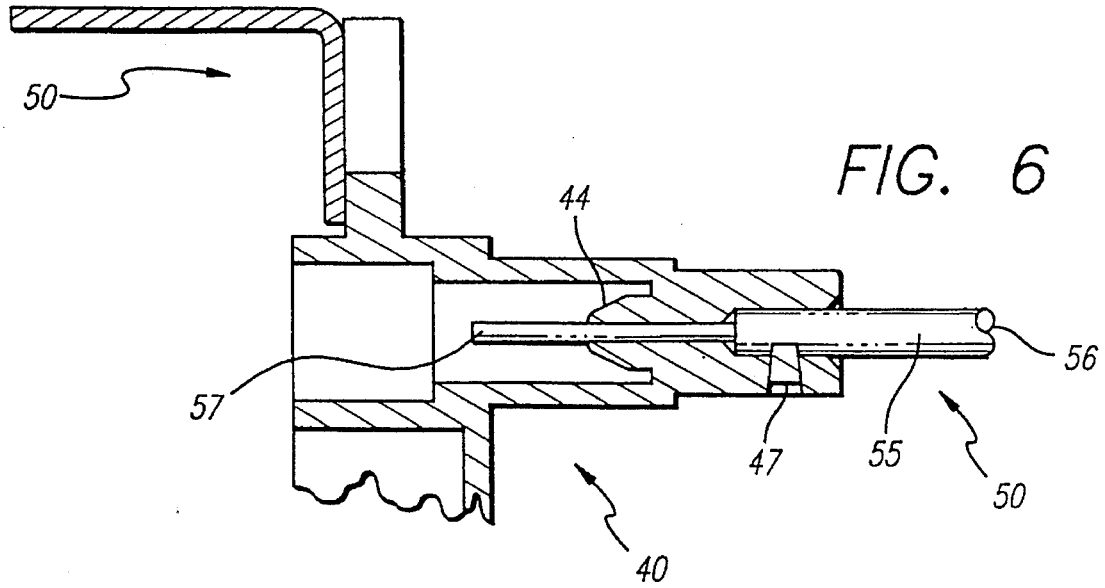
FIG. 6 is a like section of the same "first" half-connector, together with a representative associated lead, and after the lead has been retained in position by a preferred form of retaining means.
Figure 7:
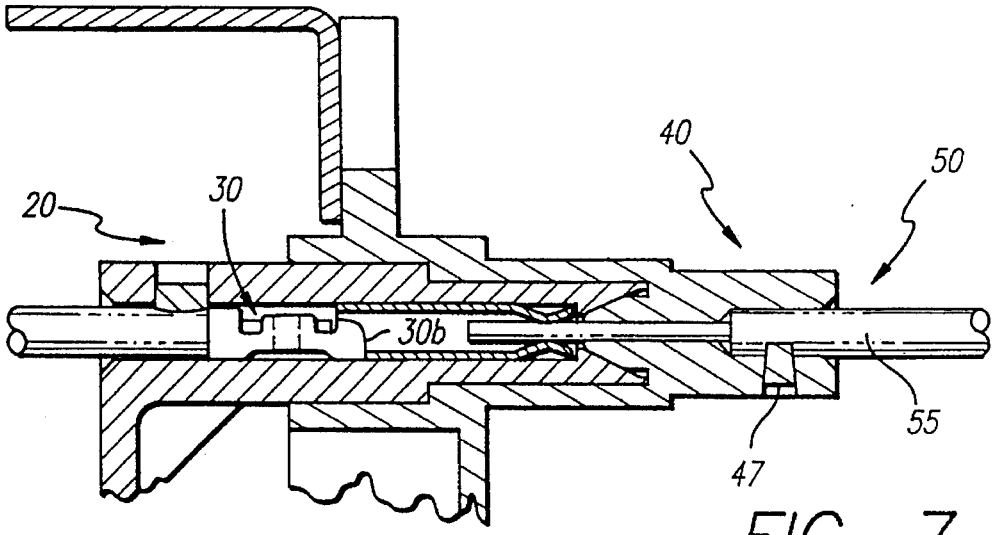
FIG. 7 is a like section of a preferred embodiment of the entire connector combination, including representative associated leads, after the two half-connectors have been mutually interengaged (part of the female contact being shown in longitudinal section in this view)
Figure 8:
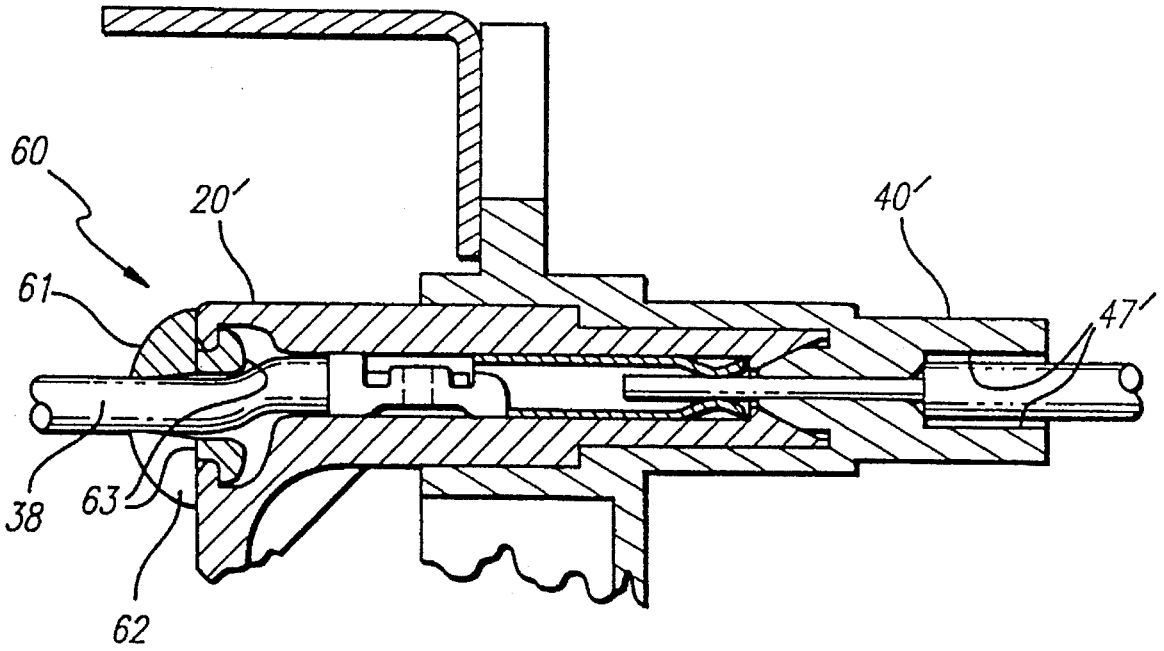
FIG. 8 is a view similar to that of FIG. 7 but showing alternative retaining means for both half-connectors.

Preferably this second half-connector 20 has a rearward block or body section 21 common to all the bores 22–24 and contacts 30, and a forward portion that is segmented to provide a separate enclosing finger 25 for each bore 22–24 and contact 30. (FIG. 3 is drawn partly broken away at 21*b* to show two of the fingers 25 and adjacent parts of the common body section 21 in section.) The spaces between these fingers 25 accommodate voltage-guarding walls that correspondingly isolate individual chambers (not shown) of the mating "first" half-connector 40 (FIGS. 5 and 6).

The second half-connector also preferably includes an integrally molded hook 26*h* and support structure 26. The hook 26*h* is used to latch this entire second half-connector 20 to the mating first half-connector 40.

In practice a female contact 30 is first attached to each lead 35–37 that will be terminated by the second half-connector 20, and all those contacts—with leads 35–37 preattached —are inserted fully into that half-connector 20 from the rear. After installation of each contact 30, the forward tip and bell 31 of the contact touches the necked-down portion 23 of its respective bore 22–24.

Each contact 30 has a narrowed waist portion 33 that is curled over and crimped tightly to grip the stripped end 37 of the associated lead 35–37, and a rearward ring 34 that is similarly crimped around the insulation 35 of that lead. The insulation 35 of each lead 35–37 is drawn broken away at 36, the rearward end of each lead actually continuing typically in a long segment (not shown) to a lamp socket or external-power connection.

Even though the bore 22–24 lacks a tang stop, conventional tang-type contacts 30 are advantageously used—as the tangs 32 tend to dig very slightly into the inner cylindrical wall 22 of the half-connector bore. This engagement tends to keep the contacts 30 and leads 35–37 in position during the light handling that continues until they are secured in place.

When the contacts 30 and leads 35–37 are all thus positioned and lightly retained, this subassembly 20–30 is processed to fix all the contacts 30 and leads 35–37 in position. To accomplish this, preferably the second half-connector 20 is brought together with an ultrasonic welding apparatus.

That apparatus is partially customized by inclusion of an array of vibration-applying bosses spaced linearly to coincide with the spacing (best seen in FIGS. 3 and 4) of the contact-holding bores. The half-connector with contacts and leads is positioned relative to the boss array of the welding apparatus, so that welding vibration will be applied at the areas where retaining slugs 27 are to be formed.

The welder is then turned on, applying both compression and vibration simultaneously so that areally limited pieces 27 of material (most typically Nylon®) of the half-connector body 20 at the pressured areas are in essence liquefied or replasticized and forced into intimate association with the insulation material 35 of the leads 35–37. The insulation material 35 is likewise locally liquefied or plasticized, so that the two materials 27, 35 fuse together.

The inward-forced pieces 27 of material, and the insulation material 35, resolidify when the welder is turned off—forming virtually unitary solid attachments between the connector 20 and insulation 35. In preparation of the drawings an attempt has been made to symbolize this condition by continuity of the sectional shading as between the slug 27 and adjacent portions of the connector wall—and by absence of any demarcation line between the slug 27 shading and the insulation 35.

In addition the now inward-protruding slugs 27 of connector material mechanically block the rear rings 34 of the contacts 30 against escape from their respective bores 22. We consider it preferable to preform an arcuate inner surface at the end of each slug 27; such shaping promotes a more effective intimate fusion of the inner surface of the slug 27 with the cylindrical outer surface of the insulation 35.

From the drawings it will be appreciated that retention may instead be obtained by driving each slug 27 inward at the point along the bore 22 where the contact 30 has a narrow waist 33. We regard this position, however, as less preferable because—there being no insulation material at that point to fuse with the connector material—it is possible to achieve only mechanical blocking, no welding action.

Using the waist 33 position may have another drawback: as the contact waist 33 is not cylindrically symmetrical, the exact extent of mechanical blocking may vary slightly with rotational orientation of the contacts 30 about the bore axis, so that some contacts may be slightly loose while others are held rigidly in place. As a result, any strain which is applied to the leads may be undesirably concentrated on just one or two contacts that are more tightly held.

In any event, after the retaining slugs 27 have been driven into position the light retention provided by the tangs 32 may continue to be present. It has served its purpose, however, and is no longer significant.

The "first" half connector 40 also has an array of through-holes, spaced in alignment with those of the second half-connector. A representative one of these holes 45–42 appears in FIGS. 5 through 8; as shown there, each hole has:

- a very small-diameter segment 42 for receiving from the rear (the right, in the drawings) the bared-wire end 57 that will serve as a male contact,
- a slightly-larger-diameter segment 42*r* for receiving the insulation 55 of that wire, and
- a corresponding still-larger separate chamber 45 for receiving from the front (left in the drawings) the respective fingers 25 of the second half-connector 20—these chambers 45 merging into a common antechamber 41 that receives the front end of the common body segment 21 of the second half-connector 20.

Each hole 45–42 in the first half-connector 40 preferably holds a contact 50 that is formed simply by baring the end 57 of a lead 55–57. Each contact/lead 50 is held in place in its hole 45–42 by, preferably, a slug-lock arrangement generally similar to that described above for the second half-connector. Ultrasonic welding (described above with respect to the second half-connector 20) may be used if desired.

If as we prefer, however, the bared-wire male contacts 57 are used in an "internal" connector 40—that is, one that is mounted to the wall 50 of a ballast—much smaller forces are present tending toward escape of the leads/contacts 50 from their holes 42. These forces are primarily limited to the guiding-and-insertion force applied during interengaging of the two half-connectors, and the vibration and impacts that occur during shipping and handling.

In this event a considerably less-expensive, purely mechanical slug-lock retention may therefore be successfully used instead. That system is fully described in the copending parent application identified above—and is symbolized in FIGS. 6 and 7 by discontinuity of shading between the slug 47 and adjacent wall material, and by a demarcation line between the slug 47 and insulation 55.

Formed at the forward end of each small-diameter front portion is a protruding generally conical guide, which reinforces part of the forward-extending bare wire tip and so protects the bare wire to some extent against deformation. The guide shape is complementary to the funnel shape formed at the front of each through-hole in the second half-connector, thus providing some additional guidance of the two contacts and two half-connectors into mutual engagement.

In use the relatively very wide mouth **24*m* of each funnel 24 in the second half-connector 20 captures the respective bare-wire tip 57—even if it is slightly bent—and steers that tip through the necked-down section 23 of the associated bore 22 into the bell 31 of the female contact 30. In this process each conical guide 44 seats in the corresponding funnel 24**.

As pointed out earlier, a primary objective of this invention is manufacturing economy. For this reason we favor implementation of the invention in configurations that can be manufactured in the least-costly-possible way.

In particular the configurations described above can be molded in plastic without so-called "side pulls", in which lateral undercuts and the like are formed in a finished part through use of extra die inserts. If this condition is relaxed, however, several variant configurations can be substituted, within the scope of our invention in accordance with certain of the appended claims.

For example a conventional tang-stop flange or ledge (not illustrated) may be retained—subdividing the rear chamber into one forward segment that receives the forward, female-contact section proper and another segment that receives the rearward, insulation-clamping ring of the contact. The relatively large-diameter forward segment of the bore, forward from the flange or ledge, can be formed through use of two or more side-pull die inserts.

With such a configuration a large-diameter funnel can be provided according to our invention while retaining the conventional tang-stop function—but at the cost of the additional tooling, and also the additional pulls in each molding cycle. This variant may be deemed preferable if the tang-stop function is considered very important.

Another, conceptually related variant consists of providing an annular enlargement (rather than constriction) partway along the rear chamber. Contact tangs can expand into such an enlargement, and seat against its annular rear wall—much as they expand conventionally into a forward chamber, and seat against an inward-extending flange or ledge.

Strong snap-together constructions can be used for various purposes in accordance with our invention, but generally require side-pull techniques to form the necessary undercuts. For example, at the rear of either half-connector a bank of snap-on retainers 60 (FIG. 8), applied after installation to displace and clamp the leads in place, can be substituted for the sonically welded (or mechanically broken-in) slugs that serve as retaining means.

The retainers have a common displacing bar 61 to form an offset 38 in each lead, and for each lead a respective separate slot 62 with a "V" shape (not illustrated) to jam and hold the lead in that offset position. Snaps 63, illustrated very schematically, are formed at suitable spacings along the bank of retainers to engage mating snaps formed inside the rear end of the connector body 20'.

Figure 9:
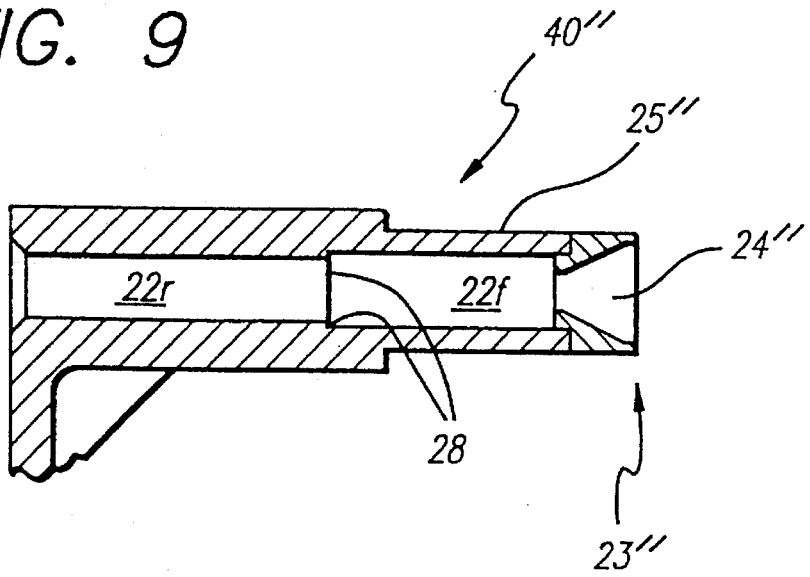
FIG. 9 is a view similar to that of FIG. 1 but showing an alternative form, within the scope of the invention, of the "second" half-connector.

As another example, snap-on or press-fit funnel sections 23" (FIG. 9) can be separately molded and then attached to the front of a generally more-conventional half-connector body 40" in which each bore **22*f*, 22*r* has a tang-stop ledge 28, and a nonnecked-down finger segment 25" at the front. Relative to conventional configurations, the illustrated half-connector 40" requires no significant modification, as a bank of funnels 24" is simply press-fit into engagement with nonreentrant forward finger segments 25"**.

Ordinarily the forces applied by the leads and female contacts forward against the necked-down section 23" are rather light, justifying use of a press-fit element. For a stronger snap-on variant, the half-connector 40" need only be modified to the extent of including the necessary mating snaps, to accommodate a bank of funnels 24" (also modified with snaps).

Another configuration calling for side-pulls, but not snaps, includes preformed slug channels (not shown) for transversely driven slugs (not shown). The slugs themselves may be molded either unitarily in a breakaway form, or separately— both these techniques being known in the art.

It is also within the scope of our invention, though not preferred, to use adhesive 47' (FIG. 8) as retaining means for the leads or contacts in a suitably modified first half-connector 40'. While adhesive 47' may be as effective as any other means when properly applied, it is more subject to variation in application technique, and less susceptible to straightforward achievement of uniformity through automation.

It will be understood that the foregoing disclosure is intended to be merely exemplary, and not to limit the scope of the invention—which is to be determined by reference to the appended claims.

What is claimed is:

1. In combination, a ballast and connecting apparatus for use in a fluorescent-lamp fixture having lamp sockets; said combination comprising:

at least one electrical winding mounted within the ballast;

two pluralities of electrical leads within the fluorescent-lamp fixture:

one plurality of electrical leads within the ballast and operatively connected to the winding, for carrying electrical power to and from the winding, and another plurality of electrical leads extending through such fixture substantially outside the ballast, at least some of these leads being operatively connected with lamp sockets of such fixture for carrying electrical power to the sockets;

two mutually matable electrical half-connectors, one for terminating said one plurality of leads and another for terminating said other plurality of leads;

a plurality of individual electrical male contacts, formed from or operatively connected to one of the two pluralities of electrical leads respectively, and fixed within a first of the two half-connectors;

a plurality of individual electrical female contacts, operatively connected to the other of the two pluralities of electrical leads respectively, and fixed within a second of the two half-connectors;

a plurality of through-holes defined within the second half-connector, each said through-hole holding a respective one of the female contacts, and each through-hole having:

a rearward end for receiving insertion of one female contact, a forward end for receiving insertion of a part of one male contact, extending from the first half-connector, into the female contact to complete connections from the ballast winding to the lamp sockets, a necked-down section, forward from a forward tip of the female contact in that hole, and a preformed bore whose transverse preformed dimensions along the entire length of the bore rearward from the necked-down forward section are at least as great as its transverse dimensions immediately rearward from the necked-down forward section; and means for retaining each female contact in its respective bore.

2. The combination of claim 1, further comprising:

a funnel-shaped forward opening, defined in a forward face of the necked-down forward section, for guiding said part of the corresponding male contact into the female contact.

3. The combination of claim 2, wherein:

the male contacts are formed as bared-wire ends of the one of the two pluralities of leads fixed within said first half-connector;

wherein the bared-wire ends are subject to bending; and the funnel-shaped forward opening tends to compensate for such bending by guiding said part of each male contact, even if slightly bent, into its corresponding female contact.

4. The combination of claim 2, further comprising:

a plurality of protruding generally conical guards, defined in the material of the first half-connector, encircling each of the male contacts respectively to protect the male contacts and help guide said part of each male contact into the funnel-shaped opening in the second half-connector.

5. The combination of claim 1, wherein:

the female-contact retaining means comprise one or more wall portions of the second half connector, displaced into or around the leads or the female contacts in the second half connector to hold those leads or the female contacts in place within the second half connector;

whereby strain relief is provided for each lead or contact in the second half connector without using any additional component.

6. The combination of claim 5, wherein:

the displaced wall portions comprise preformed pieces driven inward to engage the leads or the female contacts.

7. The combination of claim 5, wherein:

the displaced wall portions are driven inward and fused with insulation material of the leads.

8. The combination of claim 7, wherein:

the displaced portions are fused with the insulation material by ultrasonic welding.

9. The combination of claim 5, wherein:

the displaced wall portions are disposed behind the female contacts to engage the leads.

10. The combination of claim 9, wherein:

the displaced wall portions are driven inward and fused with insulation material of the leads.

11. The combination of claim 1, wherein:

the female-contact retaining means comprise adhesive for securing the contacts or the leads to the second connector body.

12. The combination of claim 1, wherein:

the female-contact retaining means comprise at least one retainer held at the rear of the second half-connector by snap-together construction.

13. The combination of claim 1, wherein:

the electrical half-connector that is for terminating said one plurality of leads is mounted to the ballast.

14. In combination, a ballast and connecting apparatus for use in a fluorescent-lamp fixture having lamp sockets; said combination comprising:

at least one electrical winding mounted within the ballast;

two pluralities of electrical leads within the fluorescent-lamp fixture:

one plurality of electrical leads within the ballast and operatively connected to the winding, for carrying electrical power to and from the winding, and another plurality of electrical leads extending through such fixture substantially outside the ballast, at least some of these leads being operatively connected with lamp sockets of such fixture for carrying electrical power to the sockets;

two mutually matable electrical half-connectors, one for terminating said one plurality of leads and another for terminating said other plurality of leads;

a plurality of individual electrical male contacts, formed from or operatively connected to one of the two pluralities of electrical leads respectively, and fixed within a first of the two half-connectors;

a plurality of individual electrical female contacts, operatively connected to the other of the two pluralities of electrical leads respectively, and fixed within a second of the two half-connectors;

a plurality of through-holes defined within the second half-connector, each said through-hole holding a respective one of the female contacts, and each through-hole having:

a rearward end for receiving insertion of one female contact, a forward end for receiving insertion of a part of one male contact, extending from the first half-connector, into the female contact to complete connections from the ballast winding to the lamp sockets, a necked-down section, forward from a forward tip of the female contact in that hole, and a funnel-shaped forward opening, defined in a forward face of the necked-down forward section, for guiding said part of the corresponding male contact into the female contact; and means for retaining each female contact in its respective hole.

15. The combination of claim 14, wherein:

the male contacts are formed as bared-wire ends of the one of the two pluralities of leads fixed within said first half-connector;

wherein the bared-wire ends are subject to bending; and the funnel-shaped forward opening tends to compensate for such bending by guiding said part of each male contact, even if slightly bent, into its corresponding female contact.

16. The combination of claim 14, further comprising:

a plurality of protruding generally conical guards, defined in the material of the first half-connector, encircling each of the male contacts respectively to protect the male contacts and help guide said part of each male contact into the funnel-shaped opening in the second half-connector.

17. The combination of claim 14, wherein:

the female-contact retaining means comprise one or more wall portions of the second half connector, displaced into or around the leads or the female contacts in the second half connector to hold those leads or the female contacts in place within the second half connector;

whereby strain relief is provided for each lead or contact in the second half connector without using any additional component.

18. The combination of claim 17, wherein:

the wall portions comprise preformed pieces driven inward to engage the leads or the female contacts.

19. The combination of claim 18, wherein:

the displaced wall portions are driven inward and fused with insulation material of the leads.

20. The combination of claim 19, wherein:

the displaced portions are fused with the insulation material by ultrasonic welding.

21. The combination of claim 17, wherein:

the displaced wall portions are disposed behind the female contacts to engage the leads.

22. The combination of claim 21, wherein:

the displaced wall portions are driven inward and fused with insulation material of the leads.

23. The combination of claim 14, wherein:

the female-contact retaining means comprise adhesive for securing the contacts or the leads to the second connector body.

24. The combination of claim 14, wherein:

the female-contact retaining means comprise at least one retainer held at the rear of the second half-connector by snap-together construction.

25. The combination of claim 14, wherein:

the electrical half-connector that is for terminating said one plurality of leads is mounted to the ballast.

26. The combination of claim 14, wherein:

the necked-down forward section, defining said funnel-shaped forward opening, for each through-hole is preformed unitarily with the rest of the second half-connector;

whereby the necked-down forward section requires no subsequent assembly to the rest of the second half-connector.

27. The combination of claim 14, wherein:

the necked-down forward section, defining said funnel-shaped forward opening, for each through-hole is preformed separately from the rest of the second half-connector and thereafter assembled to the rest of the second half-connector.

28. The combination of claim 23, wherein:

the separately preformed necked-down forward section is fixed to the rest of the second half-connector by attachment means selected from the group comprising:
adhesive;
vibratory welding; and
snap-together construction.

29. The combination of claim 14, further comprising:

a fluorescent lamp fixture, including lamp sockets.

* * * * *